US005698086A

United States Patent [19]

Herbert et al.

[11] Patent Number: 5,698,086

[45] Date of Patent: Dec. 16, 1997

[54] STEPPED HONED CORE MANDREL

[75] Inventors: William G. Herbert, Williamson; Gary J. Maier, Webster, both of N.Y.

[73] Assignee: Xerox Corporation, Stamford, Conn.

[21] Appl. No.: 723,323

[22] Filed: Sep. 30, 1996

Related U.S. Application Data

[63] Continuation of Ser. No. 436,920, May 8, 1995, abandoned.

[51] Int. Cl.[6] ..... C25D 1/00

[52] U.S. Cl. ..... 205/67; 205/70; 205/73; 205/77; 204/281; 29/23.1

[58] Field of Search ..... 205/67, 70, 73, 205/77; 29/23.1; 204/281; 474/272; 425/471

[56] References Cited

U.S. PATENT DOCUMENTS

| | | | |
|---|---|---|---|
| 2,569,367 | 9/1951 | Bradner | 425/471 |
| 3,545,996 | 12/1970 | Duncan | 427/198 |
| 4,565,607 | 1/1986 | Hanak | 437/5 |
| 4,937,030 | 6/1990 | Nishiyama et al. | 264/162 |
| 5,044,123 | 9/1991 | Hoffman | 51/73 R |
| 5,069,758 | 12/1991 | Herbert | 205/73 |
| 5,131,893 | 7/1992 | Herbert | 474/260 |
| 5,196,106 | 3/1993 | DuPree et al. | 205/67 |
| 5,451,311 | 9/1995 | Swain | 205/73 |

FOREIGN PATENT DOCUMENTS

| | | | |
|---|---|---|---|
| 2820549 | 1/1979 | Germany | C25D 5/34 |

*Primary Examiner*—John Niebling
*Assistant Examiner*—Brendan Mee
*Attorney, Agent, or Firm*—T. L. Fair

[57] ABSTRACT

An electroforming process and apparatus for forming an electroform with a roughened surface. The present invention roughens the surface of the mandrel using a sandblasting device in the center region of the mandrel allowing the two end regions to remain smooth. The intersection of the roughened center region and each of the two end regions form a step. This step on either side of the roughened center region facilitates sealing while the roughened center region enables toner distribution. The electroform created using the step roughened mandrel surface is separated from the mandrel without destroying the mandrel. The step roughened mandrel can then be reused to create another electroform with a roughened surface.

14 Claims, 1 Drawing Sheet

STEPPED HONED CORE MANDREL

This application is a continuation of application Ser. No. 08/436,920, filed May 8, 1995 and now abandoned.

CROSS REFERENCE

Cross reference is made to and priority is claimed from U.S. patent application Ser. No. 08/436,786, entitled "Honed Mandrel", in the name of Gary J. Maier et al., assigned to the same assignee as the present application and filed concurrently herewith currently pending.

BACKGROUND OF THE INVENTION

This invention relates generally to an electroforming process, and more particularly, concerns a process for enabling electroforming of thin walled tube or sleeve devices with both rough and smooth surfaces, having small diameters using a permanent mandrel.

The fabrication of hollow metal articles by an electroforming process is well known. For example, hollow metal articles are fabricated by electro-depositing a metal onto an elongated mandrel which is suspended in an electrolytic bath. The resulting seamless electroformed tubes are thereafter removed from the mandrel by sliding the tube off one end of the mandrel. Different techniques have been developed for forming and removing tubes from electroforming mandrels depending upon the cross-sectional area of the electroformed tube. Examples of these techniques are described in U.S. Pat. No. 3,844,906 to R. E. Bailey et al. and U.S. Pat. No 4,501,646 to W. G. Herbert.

Electroforms are manufactured using a bath to create surface roughness of the electroforms. This bath induced surface roughness can vary considerably along the (thickness) of the electroform. Electroforms with roughened surfaces are also made by sandblasting the surface of disposable mandrels. An electroform is then plated onto the surface of the mandrel. The plated electroform is separated from the mandrel by dissolving the mandrel. Thus, a new mandrel is required for each electroform made which is not economical.

The following disclosures may be relevant to various aspects of the present invention and may be briefly summarized as follows:

U.S. Pat. No. 5,196,106 to DuPree et al. discloses a process for forming an infrared absorbing cold shield which comprises anodizing an aluminum mandrel for the cold shield to provide a porous layer of aluminum oxide over the surface of the mandrel. The anodized mandrel is then immersed in an electroforming solution and metal is electrolytically deposited into and over the aluminum oxide layer. The aluminum mandrel is then selectively dissolved, leaving a metal body of the electroformed metal with a layer of infrared absorbing aluminum oxide mechanically anchored to the interior surface of the metal body.

U.S. Pat. No. 5,131,893 to Herbert discloses an endless metal belt assembly made with opposing adjacent belt surfaces that may contain a roughened surface containing protuberances, indentations, and/or pits and are configured such that a lubricant can be held and circulated between the adjacent surfaces. The roughened surface may be formed by an electroforming process in which one or more components of the electroforming baths and the operating parameters of the electroforming baths are adjusted to create the protuberances, indentations and/or pits. A belt assembly formed in this manner is useful as a driving member for continuously variable transmission.

U.S. Pat. No. 5,044,123 to Hoffman discloses an apparatus for producing concave or convex optically magnified facets about a gem, each facet being a curved surface that is a section of a cylinder. It utilizes a mandrel having an exterior and/or interior cylindrical abrasive surface. The mandrel is angularly movable about its central axis. The method of producing the optically magnified facet requires successive indexing of the gem and bringing it into contact with an angularly moving cylindrical abrasive surface.

U.S. Pat. No. 4,937,030 to Nishiyama et al. discloses a method of forming a slush mold and a synthetic resin skin utilizing the slush mold. The method includes the steps of roughing a foamed synthetic resin surface to define a prototype having a plurality of irregularly spaced and irregularly sized recesses, forming a metal mold to have a molding surface accurately, complimentary to the prototype surface and molding a skin of synthetic resin against the molding surface of the metal mold.

SUMMARY OF THE INVENTION

Briefly stated, and in accordance with one aspect of the present invention, there is provided a method for fabricating an electroform having a roughened surface. The method comprises the steps of roughening a surface of a mandrel, having two end regions opposed to one another and a center region located therebetween, in the center region; forming a step on the surface of the mandrel between the center region and each of the two end regions contacting the center region to create a step roughened mandrel surface; applying a layer of material on the mandrel, having the roughened surface in the center region and a smooth surface on each of the two end regions, to create a stepped roughened electroform; and separating the stepped roughened electroform from the mandrel having the step roughened mandrel surface.

Pursuant to another aspect of the present invention, there is provided an apparatus for creating a roughened electroform comprising: a mandrel having a surface comprising a center region and two end regions, the two end regions having a first end region and a second end region being opposed to one another, the center region being located between the two end regions; and means for roughening the center region forming a step between the center region and each of the two end regions.

BRIEF DESCRIPTION OF THE DRAWINGS

Other features of the present invention will become apparent as the following description proceeds and upon reference to the drawings, in which.

DETAILED DESCRIPTION OF THE INVENTION

For a general understanding of an electroforming process in which the present invention may be incorporated, reference is made to U.S. Pat. No. 4,501,646 which describes the conventional electroforming process using a core mandrel and U.S. Pat. No. 4,902,386 which describes an electroforming mandrel and method of fabricating and using same. The contents of these patents are herein incorporated by reference.

Reference is now made to the drawings where the showings are for the purpose of illustrating a preferred embodiment of the invention and not for limiting same.

Figure 1:
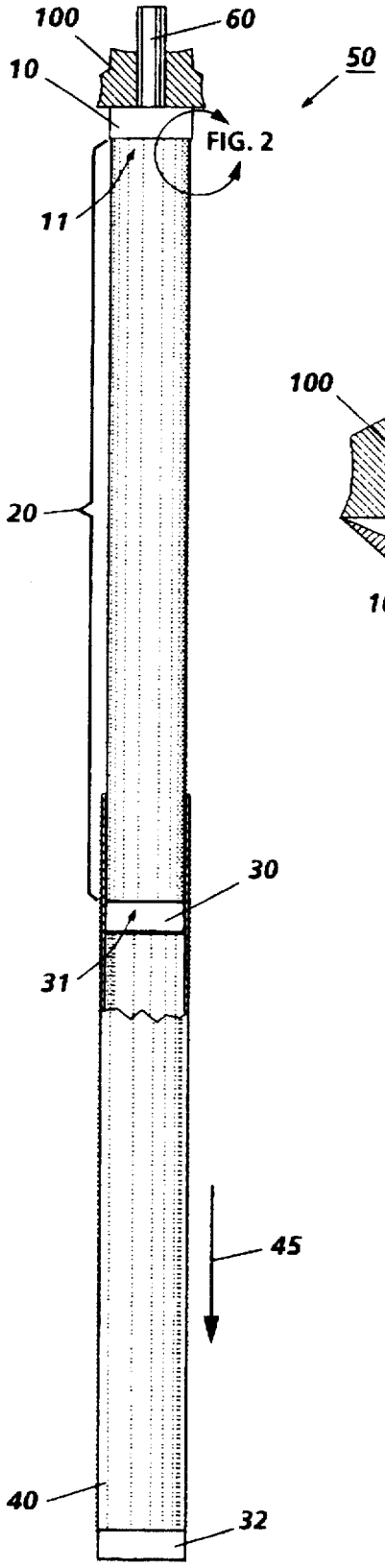
FIG. 1 shows a schematic view of a mandrel with a stepped roughened mandrel surface and a partial break away view of the roughened electroform.

Reference is now made to FIG. 1, which shows a schematic view of a stepped mandrel core with a roughened surface and a partial break away view of an electroform with a roughened surface. The mandrel is comprised of a shaft 60, two end regions 10, 30 and a center region 20. The two end regions 10, 30 are adjacently located on opposite sides of the center region 20. The center region 20 of the mandrel is roughened to create an electroform 40 with a roughened surface while the two end regions 10, 30 remain smooth. The surface is roughened by sandblasting or a similar process. The surface of the mandrel, in the present invention involves the use of a dual catalyzed non-self regulating crack free chromium deposit 70 (see FIG. 2) to maintain the roughened surface of the mandrel. (The roughened surface of the electroform 40 provides toner distribution from the developer (not shown) to the photoreceptor (not shown) as the electroform 40 rotates between the developer and the photoreceptor.) In the present invention, a thin walled electroform is fabricated which is rough in its center to facilitate the distribution of toner and smooth at its ends to facilitate sealing of the toner dispensing module. (It is noted that the present invention is applicable to either a male or female mandrel.)

With continued reference to FIG. 1, an electroform 40 is fabricated by applying current to the mandrel 50 through the shaft 60. The current facilitates plating of the mandrel 50 creating an electroform 40 having the stepped roughened surface of the mandrel 50. The present invention enables fabrication of a thin walled electroform 40 with a stepped roughened surface that facilitates the distribution of toner and sealing. The thickness of the thin walled electroform ranges from about 10 microns to about 70 microns. The surface roughness ($R_a$ or RMS) of the electroform 40 ranges from about 0.15 microns RMS to about 1.25 microns RMS. A preferred embodiment of the surface roughness of the surface roughened electroform ranges from about 0.25 microns RMS to about 0.35 microns (RMS). The smooth end regions 10, 20 are trimmed as needed, to provide a clean edge on the finished product.

Sandblasting a mandrel to create an electroform with a roughened surface has previously required the mandrel to be disposable. The affinity between the roughened surface of the mandrel and the roughened surface of the electroform in contact with the mandrel required dissolving of the mandrel to separate the electroform from the mandrel. This process is both expensive and time consuming because each fabrication of an electroform requires a new mandrel.

Additionally, creating an electroform with a roughened surface using an electro-depositing bath requires thicker deposits of the material being plated (e.g about 60 microns to about 125 microns). Sandblasting the surface of the mandrel, as in the present invention, allows the use of thinner films as electroforms. The thickness of the thinner films made by the sandblasted roughened surfaces of the mandrel range from about 0.025 mm to about 0.05 mm.

Referring again to FIG. 1, the preferred embodiment of the present invention involves stepping the mandrel 50 so that the mandrel 50 can be reused while avoiding the stretching and rippling commonly associated with roughening after electroforming. A step 11, 31 is created where the smooth end region 10, 30 (e.g. the region that has not been roughened) and the roughened mandrel surface meet. The step 11, 31 can be on the order of 100 to 150% of the roughening in the present invention. For example, if the roughening of the mandrel surface is about 1.27 microns RMS (root mean square), then the step 11, 31 can be as small as 1.27 microns minus the hysteresis associated with cold shock parting, net internal stress, and differences in thermal coefficients of expansion. Other examples of step dimensions tested include steps having a height of about 0.0025 mm and about 0.005 mm which did not effect the functionality of the sleeve.

Electroforming a smooth sleeve on a permanent mandrel and then sandblasting or otherwise roughening the center, after parting, causes the roughened center to be worked and stretched as a result of the work. The stretched center and the margin (i.e. the region between the rough and smooth areas which often ripples) between the two surfaces is problematic (especially with thin devices) and, controlling the amount of stretch is difficult. These problems are eliminated in the present invention.

Electroforming sleeves, belts, or tubes (e.g. nickel, copper and brass) with diameters of less than about 40 mm requires that one capitalize on hysteresis and use a system which produces an electroform which is at least nearly zero in internal tensile stress. Stress reducers are required to maintain the desired internal stress. The stress reducers also cause the electroform deposit to be smooth. If a rough mandrel is used to get the desired roughness, it is required that even more stress reducers be used so that the electroform can be separated from the mandrel, thus, defeating the purpose of roughening the mandrel.

Small diameter (i.e. about 25 mm) thin walled nickel sleeves (of about 0.04 mm) with surface roughness ($R_a$) of about 0.33 microns have been found to be useful as toner donor roll coverings. In the prior art, these sleeves are made on a non-permanent mandrel. Each sleeve requires the production of a mandrel which can only be used once making this process very expensive.

The present invention involves sandblasting a mandrel which has been chromium plated with a dual catalyzed non-self regulating crack free chromium. The chromium plating produces a deposit which is rough at its inception and will continue to be sufficiently rough throughout the life of the mandrel even when substantial levels of stress reducers are added. This enables easy parting and economical production of parts.

Figure 3:
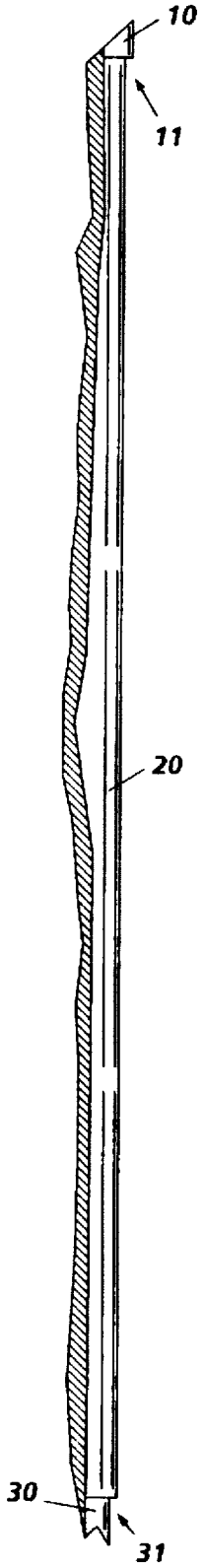
FIG. 3 shows a partial magnified diagrammatic schematic view of the stepped roughened center region mandrel of the present invention.

Referring again to FIG. 1, the top end region 10 has a larger diameter than the bottom end region 30. The slightly larger diameter of the top end region 10 creates a step 11 in the center region 20 and another step 31 occurs where the center region 20 meets to the smaller diameter of the bottom end region 30. The diameter of the stepped mandrel varies according to the size of the electroform required. An example of diameters for an electroform created on the mandrel 50 of FIG. 1 with a roughness of 0.2 microns are: about 25.4000 mm for the end region 10; about 25.3989 mm for the center region 20; and about 25.3976 mm for the end region 30 (see FIG. 3). (It is noted that FIG. 3 is significantly modified to illustrate these diameter dimensions.) This enables removal of the electroform 40, having a smooth top end region (not shown) and a smooth bottom end region 32, from the mandrel by sliding the electroform, in the direction of arrow 45, after parting (i.e. separation) between the mandrel 50 and the electroform 40 has occurred. Another embodiment of the present invention involves sandblasting a stainless steel mandrel to produce a roughened electroform.

Figure 2:
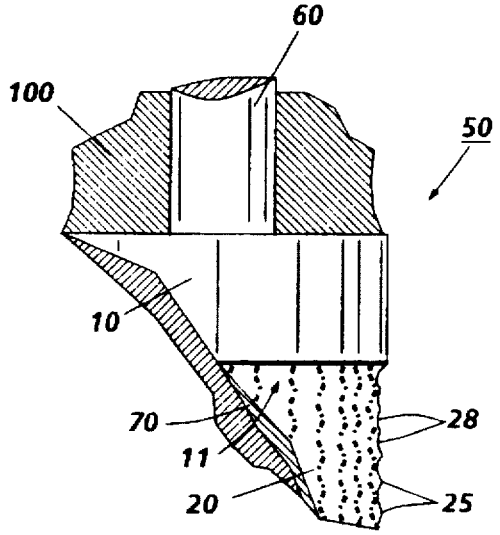
FIG. 2 shows a partial enlarged view of the first step between the smooth end region and the roughened center region of the mandrel of FIG. 1.

Reference is now made to FIG. 2, which shows a partial enlargement of the first stepped region 11, indicated in FIG. 1. The step 11 occurs where the smooth end region 10 and the roughened center region 20 meet. The second stepped region 31 is similarly created (see FIG. 1). Sandblasting the center region creates protuberances 25 (i.e. peaks) and pits 28 (i.e. valleys) in the surface of the mandrel forming the roughened surface. The roughened surface of the mandrel and the smooth surface of the each of the end regions meet forming a step. The smooth end region 10 forms a step of the mandrel being as high as the protuberances 25 from the roughened surface.

Reference is now made to FIG. 3, which shows a partial magnified diagrammatic schematic view of the present invention. A second step 31 occurs where the roughened region 20 and the smooth end region 30 meet. The smooth end region 30 forms a step 31 that can be as low as the pits 28 (see FIG. 2).

In recapitulation, the present invention discloses a stepped roughened mandrel for creating an electroform with a roughened surface. The surface of the stepped roughened mandrel has a chromium surface. The mandrel is plated with a material (e.g. metal) in a thin layer to form an electroform. The stepped mandrel enables the creation of a thin walled electroform, having a small diameter, which is rough in its center to facilitate the distribution of toner and smooth at its ends to facilitate sealing of the ends of the toner dispensing region. The chromium surface of the mandrel maintains the roughened surface of the permanent mandrel allowing reuse of the mandrel for the creation of new roughened surface electroforms. An alternate embodiment involves the use of stainless steel mandrel without a chromium deposit on the surface.

It is therefore apparent, that there has been provided in accordance with the present invention, an electroform with a roughened surface that fully satisfies the aim and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It is claimed:

1. A method for fabricating an electroform having a roughened surface, comprising:

roughening a center region of a chromium surface of a mandrel, having two end regions opposed to one another and the center region located therebetween;

forming steps on the surface of the mandrel where the roughened surface of the center region of the mandrel and each of the two end regions, being smooth, meet creating a step roughened mandrel surface, one step comprising a first end region of the mandrel being as high as protuberances of the roughened surface and another step comprising the second end region being as low as pits of the roughened surface;

applying a layer of material on the mandrel, having the roughened surface in the center region and a smooth surface on each of the two end regions, to create a stepped roughened electroform;

separating the stepped roughened electroform from the mandrel having the step roughened mandrel surface, the stepped roughened electroform facilitating distribution of toner particles between developing and an imaging surface; and reusing the mandrel, having a step roughened mandrel surface for applying material thereto, to form another stepped roughened electroform.

2. A method as recited in claim 1, wherein the step of roughening comprises sandblasting the center region of the mandrel to create the protuberances and pits thereon.

3. A method as recited in claim 2, wherein the applying step comprises plating the surface of the mandrel with a material having a thickness of about 10 microns to about 70 microns.

4. A method as recited in claim 3, wherein the separating step comprises:

parting the stepped roughened electroform from the mandrel, having the step roughened mandrel surface, maintaining integrity of the mandrel, having the step roughened mandrel surface; and removing the electroform, along a longitudinal axis of the mandrel having the step roughened mandrel surface, to separate the stepped roughened electroform therefrom.

5. An apparatus for creating a roughened electroform comprising:

a chromium plated mandrel having a surface comprising a center region and two end regions, the two end regions having a first end region and a second end region being opposed to one another, the center region being located between the two end regions, said mandrel being reusable; and means for roughening the center region of the surface of the mandrel by creating protuberances and pits thereon the roughened surface of the center region of the mandrel and the smooth surface of each of the end regions of the mandrel form steps, the steps comprising the meeting of the roughened surface of the center region of the surface of the mandrel and each of the two end regions, being smooth, creating a step roughened mandrel surface, one step comprising the first end region of the mandrel being as high as the protuberances of the roughened surface and another step comprising the second end region being as low as the pits of the roughened surface.

6. An apparatus as recited in claim 5, wherein the center region comprises a roughened surface for toner distribution and the two end regions each comprise a smooth surface to facilitate sealing of the roughened electroform.

7. An apparatus as recited in claim 6, wherein said roughening means comprises a sandblasting device.

8. An apparatus as recited in claim 7, wherein said sandblasting device roughens the center region of the surface of the mandrel by creating protuberances and pits thereon.

9. An apparatus for creating a roughened electroform comprising:

a chromium plated mandrel having a surface comprising a center region and two end regions, the two end regions having a first end region and a second end region being opposed to one another, the center region being located between the two end regions, said mandrel being reusable; and means for roughening the center region comprising a sandblasting device, said sandblasting device roughens the center region of the surface of the mandrel by creating protuberances and pits thereon, the roughened surface of the center region of the mandrel and the smooth surface of each of the end regions of the mandrel form steps, the steps comprising the meeting of the roughened surface of the center region of the surface of the mandrel and each of the two end regions, being smooth, creating a step roughened mandrel surface, one step comprising the first end region of the mandrel being as high as the protuberances of the roughened surface and another step comprising the second end region being as low as the pits of the roughened surface, the center region comprises a roughened surface for toner distribution and the two end regions each comprise a smooth surface to facilitate sealing of the roughened electroform.

10. An apparatus as recited in claim 9, wherein the step roughened mandrel surface having material applied thereon forms a stepped roughened electroform on the step roughened mandrel.

11. An apparatus as recited in claim 10, wherein the material being applied comprises a thickness range of about 10 microns to about 70 microns.

12. An apparatus as recited in claim 11, further comprising a means for separating the stepped roughened electroform from the step roughened mandrel surface.

13. An apparatus as recited in claim 12, wherein the separating means comprises:

means for parting the stepped roughened electroform from the step roughened mandrel surface maintaining the integrity of the mandrel having the step roughened mandrel surface; and means for removing the electroform, along a longitudinal axis of the mandrel having the step roughened mandrel surface, to separate the stepped roughened electroform therefrom.

14. An apparatus as recited in claim 13, wherein the first end region having a larger diameter than the second end region enables ease of removal of the stepped roughened electroform from the mandrel.

* * * * *